US007978159B2

(12) United States Patent
Kim et al.

(10) Patent No.: US 7,978,159 B2
(45) Date of Patent: Jul. 12, 2011

(54) ORGANIC LIGHT EMITTING DIODE DISPLAY DEVICE AND DRIVING METHOD THEREOF

(75) Inventors: In Hwan Kim, Seoul (KR); Seung Chan Byun, Incheon (KR); Jin Hyoung Kim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 1047 days.

(21) Appl. No.: 11/822,022

(22) Filed: Jun. 29, 2007

(65) Prior Publication Data

US 2008/0007494 A1 Jan. 10, 2008

(30) Foreign Application Priority Data

Jun. 30, 2006 (KR) ..... 10-2006-0060774

(51) Int. Cl.
*G09G 3/30* (2006.01)

(52) U.S. Cl. ..... 345/77; 345/76; 345/204; 340/815.4; 315/169.3; 315/383

(58) Field of Classification Search ..... 345/76–100, 345/204; 315/169.3; 349/72
See application file for complete search history.

(56) References Cited

U.S. PATENT DOCUMENTS

| | | | | |
|---|---|---|---|---|
| 4,489,349 | A * | 12/1984 | Okada | 348/674 |
| 6,078,302 | A * | 6/2000 | Suzuki | 345/77 |
| 6,580,410 | B1 * | 6/2003 | Nishimura et al. | 345/89 |
| 6,603,104 | B1 * | 8/2003 | Lee | 250/205 |
| 6,617,797 | B2 * | 9/2003 | Higuchi et al. | 315/169.1 |
| 6,633,343 | B2 * | 10/2003 | Ito et al. | 348/674 |
| 6,654,028 | B1 * | 11/2003 | Yamakawa | 345/690 |
| 6,762,800 | B1 * | 7/2004 | Nie et al. | 348/687 |
| 6,774,875 | B2 * | 8/2004 | Tong et al. | 345/63 |
| 6,906,726 | B2 * | 6/2005 | Suzuki | 345/596 |
| 6,952,193 | B2 * | 10/2005 | Abe et al. | 345/87 |
| 7,093,941 | B2 * | 8/2006 | Kawashima et al. | 353/97 |
| 7,139,008 | B2 * | 11/2006 | Mori et al. | 345/690 |
| 7,375,711 | B2 * | 5/2008 | Horiuchi et al. | 345/89 |
| 7,646,362 | B2 * | 1/2010 | Mizukoshi et al. | 345/76 |
| 2001/0035850 | A1 * | 11/2001 | Okamoto et al. | 345/77 |

(Continued)

FOREIGN PATENT DOCUMENTS

JP 2003-280592 10/2003

(Continued)

*Primary Examiner* — Sumati Lefkowitz
*Assistant Examiner* — Grant D Sitta
(74) *Attorney, Agent, or Firm* — Morgan, Lewis & Bockius LLP

(57) ABSTRACT

An organic light emitting diode display device for changing a gamma reference voltage step by step in accordance with an image brightness of a current frame to reduce damage with which the organic light emitting diode and the driving transistor thereof are applied is disclosed. In the organic light emitting diode display device, a brightness detector calculates a maximum brightness value of each pixel using inputted image data of current frame. An adder adds all maximum brightness values of each pixel which are detected by the brightness detector. An average value calculator calculates an average brightness value of a current frame using an added value of maximum brightness values which are added by the adder. A gamma weight calculator calculates a gamma reference voltage weight which is set to correspond to the calculated average brightness value among predetermined gamma reference voltage weights. And a gamma reference voltage generator changes a gamma reference voltage step by step in accordance with a gamma reference voltage weight which is calculated by the gamma weight calculator.

21 Claims, 7 Drawing Sheets

U.S. PATENT DOCUMENTS

2002/0033783 A1* 3/2002 Koyama ..... 345/82
2002/0158882 A1* 10/2002 Liaw et al. ..... 345/589
2002/0180680 A1* 12/2002 Moon ..... 345/89
2003/0122759 A1* 7/2003 Abe et al. ..... 345/89
2004/0021671 A1* 2/2004 Leyvi ..... 345/589
2004/0169627 A1* 9/2004 Hong ..... 345/89
2004/0233229 A1* 11/2004 Kimura ..... 345/690
2005/0001801 A1* 1/2005 Kim ..... 345/89
2005/0122287 A1* 6/2005 Nishitani et al. ..... 345/63
2005/0179639 A1* 8/2005 Hsieh ..... 345/102
2005/0285828 A1* 12/2005 Inoue et al. ..... 345/76

FOREIGN PATENT DOCUMENTS

JP 2005-208314 8/2005
JP 2005-345678 12/2005

* cited by examiner

ORGANIC LIGHT EMITTING DIODE DISPLAY DEVICE AND DRIVING METHOD THEREOF

This application claims the benefit of Korean Patent Application No. P2006-060774 in Korea on Jun. 30, 2006, which is hereby incorporated by reference.

BACKGROUND OF THE INVENTION

1. Field of the Invention

The present invention relates to an organic light emitting diode display device, and more particularly to an organic light emitting diode display device that is adaptive for changing a gamma reference voltage step by step in accordance with an image brightness of a current frame, and a driving method thereof.

2. Description of the Related Art

Recently, there have been developed various flat panel display devices reduced in weight and bulk that is capable of eliminating disadvantages of a cathode ray tube. Such flat panel display devices include a liquid crystal display (hereinafter, referred to as "LCD"), a field emission display (hereinafter, referred to as "FED"), a plasma display panel (hereinafter, referred to as "PDP"), and an electro-luminescence (hereinafter, referred to as "EL") display device, etc.

The EL display device among the flat panel display devices is a self-luminous device which radiates a fluorescent material by a re-combination of an electron and a hole. The EL display device is largely classified into an inorganic EL display device which uses an inorganic compound and an organic EL display device which uses an organic compound depending upon the fluorescent material. Since such an EL display device has been highlighted as a post-generation display owing to its advantage of a low voltage driving, a self-luminous, a thin profile, a wide viewing angle, a fast response speed, and a high contrast, etc.

The organic EL display device is comprised of an electron injection layer, an electron transport layer, a light emitting layer, a hole transport layer, and a hole injection layer. Herein, the electron injection layer is disposed between a cathode and an anode. In the organic EL display device, if a predetermined voltage is applied between an anode and a cathode, an electron which is generated from a cathode moves toward a light emitting layer via the electron injection layer and the electron transport layer, and a hole which is generated from an anode moves toward a light emitting layer via the hole injection layer and the hole transport layer. Thus, an electron and a hole which are supplied from the electron transport layer and the hole transport layer are re-combined to generate a light in the organic light emitting layer.

A circuit configuration of each pixel which is formed at an organic light emitting diode display device of the related art using an organic EL will be described with reference to FIG. 1.

FIG. 1 is an equivalent circuit diagram showing a pixel which is included in an organic light emitting diode display device of the related art.

Referring to FIG. 1, each pixel of the organic light emitting diode display device includes a switch transistor S_TR1, a storage capacitor Cst, an organic light emitting diode OLED, and a driving transistor D_TR1. Herein, The switch transistor S_TR1 is turned-on by a scanning pulse which is supplied via a gate line GL to switch a data voltage which is supplied via a data line DL. The storage capacitor Cst charges a data voltage which is supplied via the switch transistor S_TR1. The organic light emitting diode OLED is turned-on by a driving current which is supplied from a power terminal to which a high potential power voltage VDD is applied to be radiated. The driving transistor D_TR1 is turned-on by a data voltage which is supplied via the switch transistor S_TR1 or a charged voltage of the storage capacitor Cst to drive the organic light emitting diode OLED.

The switch transistor S_TR1 is a NMOS transistor having a gate electrode, a drain electrode, and a source electrode. Herein, the gate electrode is connected to the gate line GL. The drain electrode is connected to the data line DL. The source electrode is commonly connected to the storage capacitor Cst and the gate electrode of the driving transistor D_TR1. The switch transistor S_TR1 is turned-on by a scanning pulse which is supplied via the gate line GL to supply a data voltage which is supplied via the data line DL to the storage capacitor Cst and the driving transistor D_TR1.

One side of the storage capacitor Cst is commonly connected to the switch transistor S_TR1 and a gate electrode of the driving transistor D_TR1, and the other side of the storage capacitor Cst is connected to a ground. The storage capacitor Cst is charged by a data voltage which is supplied via the switch transistor S_TR1. The storage capacitor Cst discharges a discharge voltage thereof to hold a gate voltage of the driving transistor D_TR1 from a point that a data voltage, which is supplied via the switch transistor S_TR1, is not applied to a gate electrode of the driving transistor D_TR1. Accordingly, although a data voltage which is supplied via the switch transistor S_TR1 is not supplied, the driving transistor D_TR1 is maintained as a turned-on state by a discharge voltage of the storage capacitor Cst for a holding period when is hold by the storage capacitor Cst. Herein, a point that a data voltage, which is supplied via the switch transistor S_TR1, is not applied to a gate electrode of the driving transistor D_TR1 is a point that a gate voltage of the driving transistor D_TR1 is dropped.

The organic light emitting diode OLED has an anode and a cathode. In this case, the anode is connected to a power terminal to which a high potential power voltage VDD is applied. The cathode is connected to a drain electrode of the driving transistor D_TR1.

The driving transistor D_TR1 is a NMOS transistor having a gate electrode, a drain electrode, and a source electrode. Herein, the gate electrode is commonly connected to a source electrode of the switch transistor S_TR1 and the switch transistor S_TR1. The drain electrode is connected to a cathode of the organic light emitting diode OLED. The source electrode is connected to a ground. The driving transistor D_TR1 is turned-on by a data voltage which is supplied to a gate electrode via the switch transistor S_TR1 or a discharge voltage of the switch transistor S-TR1 which is supplied to a gate electrode to switch a driving current which is flowed into the organic light emitting diode OLED to a ground. Thus, the organic light emitting diode OLED is radiated by a driving current which is generated by a high potential power voltage VDD.

The organic light emitting diode display device of the related art, which includes the pixels that have the above-mentioned equivalent circuit, analyzes an image data of a current frame which is inputted from a system to drive the organic light emitting diode OLED and the driving transistor D_TR1 in accordance with brightness of an image as follows.

Referring to FIG. 2A, if an image of a current frame, which is inputted from a system, is a dark color or is partially a dark color, the organic light emitting diode device of the related art drives the organic light emitting diode OLED and the driving transistor D_TR1 in order to generate a predetermined peak brightness. Thus, the organic light emitting diode device of the related art has a problem in that the organic light emitting diode OLED and the driving transistor D_TR1 thereof are damaged.

Furthermore, referring to FIG. 2B, if an image of a current frame, which is inputted from a system, is bright color, the organic light emitting diode device of the related art drives the organic light emitting diode OLED and the driving transistor D_TR1 in order to generate a predetermined minimum brightness. Thus, the organic light emitting diode device of the related art has a problem in that the organic light emitting diode OLED and the driving transistor D_TR1 thereof are damaged.

SUMMARY OF THE INVENTION

The present invention is to solve the above-mentioned problem. Accordingly, it is an object of the present invention to provide an organic light emitting diode display device that is adaptive for changing a gamma reference voltage step by step in accordance with an image brightness of a current frame, and a driving method thereof.

It is another object of the present invention to provide an organic light emitting diode display device that is adaptive for changing a gamma reference voltage step by step in accordance with an image brightness of a current frame to reduce damage with which the organic light emitting diode and the driving transistor thereof are applied, and a driving method thereof.

In order to achieve these and other objects of the invention, an organic light emitting diode display device according to an embodiment of the present invention comprises a brightness detector that calculates a maximum brightness value of each pixel using inputted image data of current frame; an adder that adds all maximum brightness values of each pixel which are detected by the brightness detector; an average value calculator that calculates an average brightness value of a current frame using an added value of maximum brightness values which are added by the adder; a gamma weight calculator that calculates a gamma reference voltage weight which is set to correspond to the calculated average brightness value among predetermined gamma reference voltage weights; and a gamma reference voltage generator that changes a gamma reference voltage step by step in accordance with a gamma reference voltage weight which is calculated by the gamma weight calculator.

In the organic light emitting diode display device, the brightness detector analyzes gray scale levels of the inputted image data of a current image for each pixel, and then detects brightness values of each pixel using analyzed gray scale levels of image data.

In the organic light emitting diode display device, the brightness detector calculates a maximum brightness value of each pixel among detected brightness values of each pixel to output it to the adder.

In the organic light emitting diode display device, the average value calculator divides an added value of the maximum brightness values by a predetermined resolution to calculate the share as an average brightness value of a current frame, thereby outputting it to the gamma weight calculator.

In the organic light emitting diode display device, the gamma weight calculator stores a predetermined look-up table where a gamma reference voltage weight, which maintains a gamma reference voltage, gamma reference voltage weights having gamma reference voltages, which are increased step by step, and gamma reference voltage weights having gamma reference voltages, which are decreased step by step, are set.

In the organic light emitting diode display device, the gamma weight calculator compares the calculated average brightness value of a current frame with a predetermined reference brightness value to calculate a gamma reference voltage weight, which is set to the predetermined look-up table, in accordance with the compared result, thereby supplying it to the gamma reference voltage generator.

In the organic light emitting diode display device, if the calculated average brightness value of a current frame is the same as the predetermined reference brightness value, the gamma weight calculator calculates the gamma reference voltage weight, which maintains a gamma reference voltage, from the predetermined look-up table.

In the organic light emitting diode display device, the gamma reference voltage generator maintains a level of a gamma reference voltage, which is being supplied at the present time, in accordance with the gamma reference voltage weight which maintains a gamma reference voltage.

In the organic light emitting diode display device, if the calculated average brightness value of a current frame is higher than the predetermined reference brightness value, the gamma weight calculator calculates a gamma reference voltage weight, which is set to correspond to the calculated average brightness value among the gamma reference voltage weights having the gamma reference voltages which are decreased step by step, from the predetermined look-up table.

In the organic light emitting diode display device, the gamma reference voltage generator decreases a gamma reference voltage, which is supplied in accordance with a gamma reference voltage weight which is calculated by the gamma weight calculator among the gamma reference voltage weights having the gamma reference voltages which are decreased step by step, step by step.

In the organic light emitting diode display device, if the calculated average brightness value of a current frame is lower than the predetermined reference brightness value, the gamma weight calculator calculates a gamma reference voltage weight, which is set to correspond to the calculated average brightness value among the gamma reference voltage weights having the gamma reference voltages which are increased step by step, from the predetermined look-up table.

In the organic light emitting diode display device, the gamma reference voltage generator increases a gamma reference voltage, which is supplied in accordance with a gamma reference voltage weight which is calculated by the gamma weight calculator among the gamma reference voltage weights having the gamma reference voltages which are increased step by step, step by step.

The organic light emitting diode display device further comprising a data driver that converts an analog data voltage step by step proportional to a gamma reference voltage, which is changed step by step and supplied from the gamma reference voltage generator, to supply it to data lines on a display panel, and wherein the brightness detector, the adder, the average value calculator and the gamma weight calculator are incorporated into a timing controller for controlling a driving timing of the data driver.

A method of driving an organic light emitting diode display device of the present invention comprises calculating a maximum brightness value of each pixel using inputted image data of a current frame; adding the calculated all maximum brightness values of each pixel to calculate an added value of maximum brightness values of each pixel; calculating an average brightness value of a current frame using an added value of the maximum brightness values; calculating a gamma reference voltage weight which is set to correspond to the calculated average brightness value among determined gamma reference voltage weights; and changing a gamma reference voltage step by step in accordance with the calculated gamma reference voltage weight.

In the method, the step of calculating the maximum brightness value analyzes gray scale levels of the inputted image data of a current image for each pixel, and then detects brightness values of each pixel using analyzed gray scale levels of image data.

In the method, the step of calculating the maximum brightness value calculates a maximum brightness value of each pixel among the detected brightness values of each pixel.

In the method, the step of calculating the average brightness value divides an added value of the maximum brightness values by a predetermined resolution to output the share as an average brightness value of a current frame.

In the method, the step of calculating the gamma weight calculates a gamma reference voltage weight from a predetermined look-up table where a gamma reference voltage weight, which maintains a gamma reference voltage, gamma reference voltage weights having gamma reference voltages, which are increased step by step, and gamma reference voltage weights having gamma reference voltages, which are decreased step by step, are set.

In the method, the step of calculating the gamma weight compares the calculated average brightness value of a current frame with a predetermined reference brightness value to calculate a gamma reference voltage weight, which is set to the predetermined look-up table, in accordance with the compared result.

In the method, if the calculated average brightness value of a current frame is the same as the predetermined reference brightness value, the step of calculating the gamma weight calculates the gamma reference voltage weight, which maintains a gamma reference voltage, from the predetermined look-up table.

In the method, the step of generating the gamma reference voltage maintains a level of a gamma reference voltage, which is being supplied at the present time, in accordance with the gamma reference voltage weight which maintains a gamma reference voltage.

In the method, if the calculated average brightness value of a current frame is higher than the predetermined reference brightness value, the step of calculating the gamma weight calculates a gamma reference voltage weight, which is set to correspond to the calculated average brightness value among the gamma reference voltage weights having the gamma reference voltages which are decreased step by step, from the predetermined look-up table.

In the method, the step of gamma reference voltage decreases a gamma reference voltage, which is supplied in accordance with a calculated gamma reference voltage weight among the gamma reference voltage weights having the gamma reference voltages which are decreased step by step, step by step.

In the method, if the calculated average brightness value of a current frame is lower than the predetermined reference brightness value, the step of calculating the gamma weight calculates a gamma reference voltage weight, which is set to correspond to the calculated average brightness value among the gamma reference voltage weights having the gamma reference voltages which are increased step by step, from the predetermined look-up table.

In the method, the step of generating the gamma reference voltage increases a gamma reference voltage, which is supplied in accordance with a calculated gamma reference voltage weight among the gamma reference voltage weights having the gamma reference voltages which are increased step by step, step by step.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Hereinafter, the preferred embodiments of the present invention will be described in detail with reference to the accompanying drawings.

Figure 3:
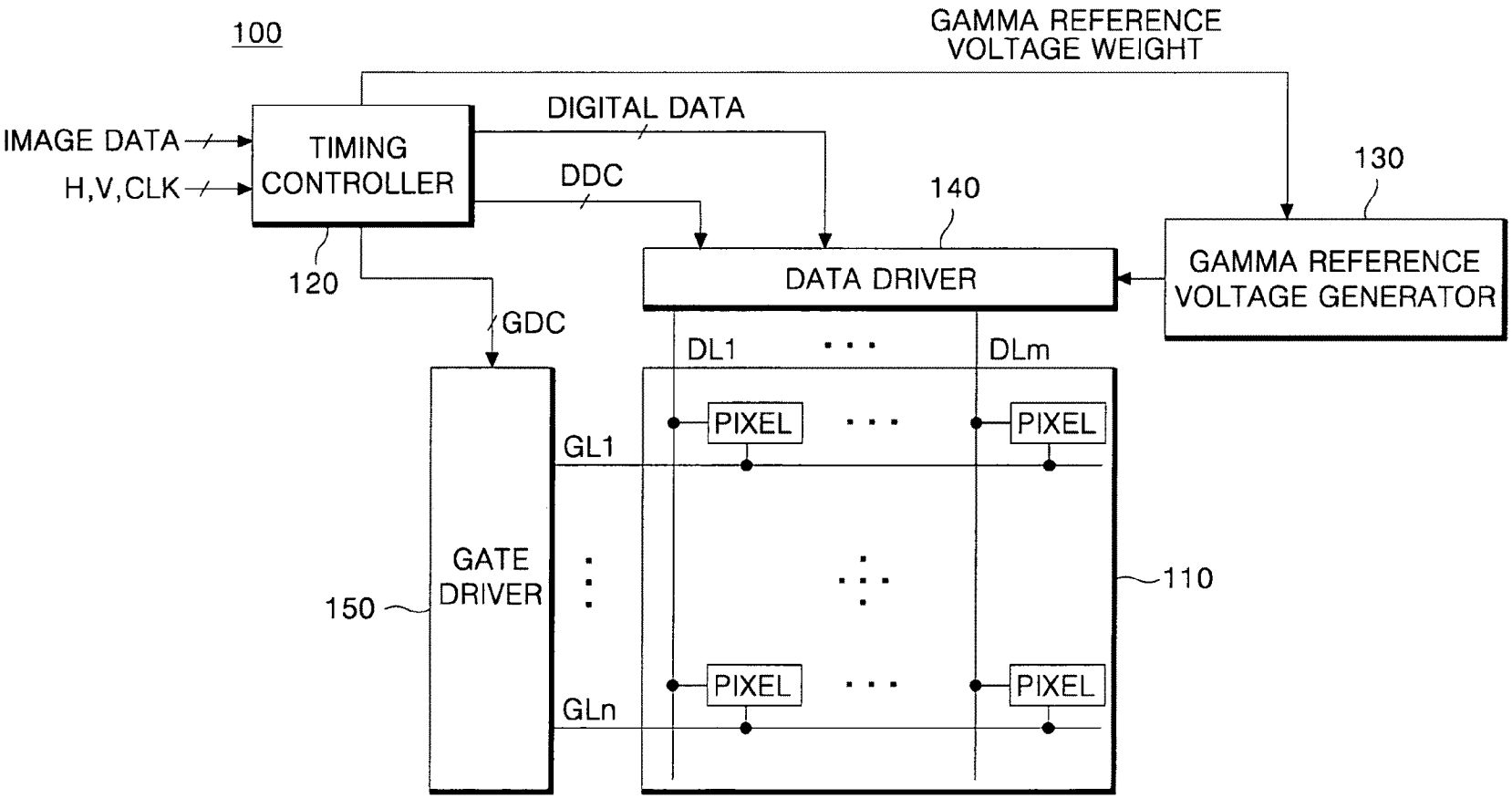
FIG. 3 is a diagram showing a configuration of an organic light emitting diode display device according to an embodiment of the present invention.

FIG. 3 is a diagram showing a configuration of an organic light emitting diode display device according to an embodiment of the present invention.

Referring to FIG. 3, an organic light emitting diode display device 100 of the present invention includes a display panel 110, a timing controller 120, a gamma reference voltage generator 130, a data driver 140, and a gate driver 150. Herein, the timing controller 120 controls a driving timing of an image data of an inputted current frame which is inputted from a system and, at the same time controls a change of a gamma reference voltage in accordance with an image brightness of a current frame. The gamma reference voltage generator 130 changes a gamma reference voltage step by step in accordance with a gamma reference voltage weight, which is outputted from the timing controller 120, and supplies it. The data driver 140 converts a digital data, which is outputted from the timing controller 120, into an analog data voltage step by step to supply it to a plurality of data lines DL1 to DLm on the basis of a gamma reference voltage, which is changed step by step and supplied from the gamma reference voltage generator 130, in accordance with a data driving control signal DDC from the timing controller 120. The gate driver 150 sequentially supplies a scanning pulse to the gate lines GL1 to GLn in accordance with a gate driving control signal from the timing controller 120.

Figure 1:
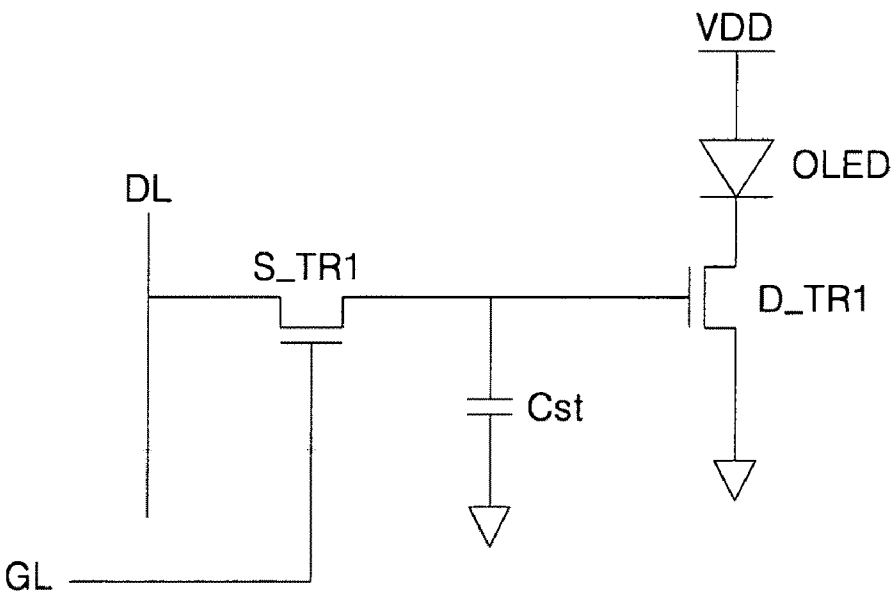
FIG. 1 RELATED ART
FIG. 1 is an equivalent circuit diagram showing a pixel which is included in an organic light emitting diode display device of the related art.
Figure 2A:
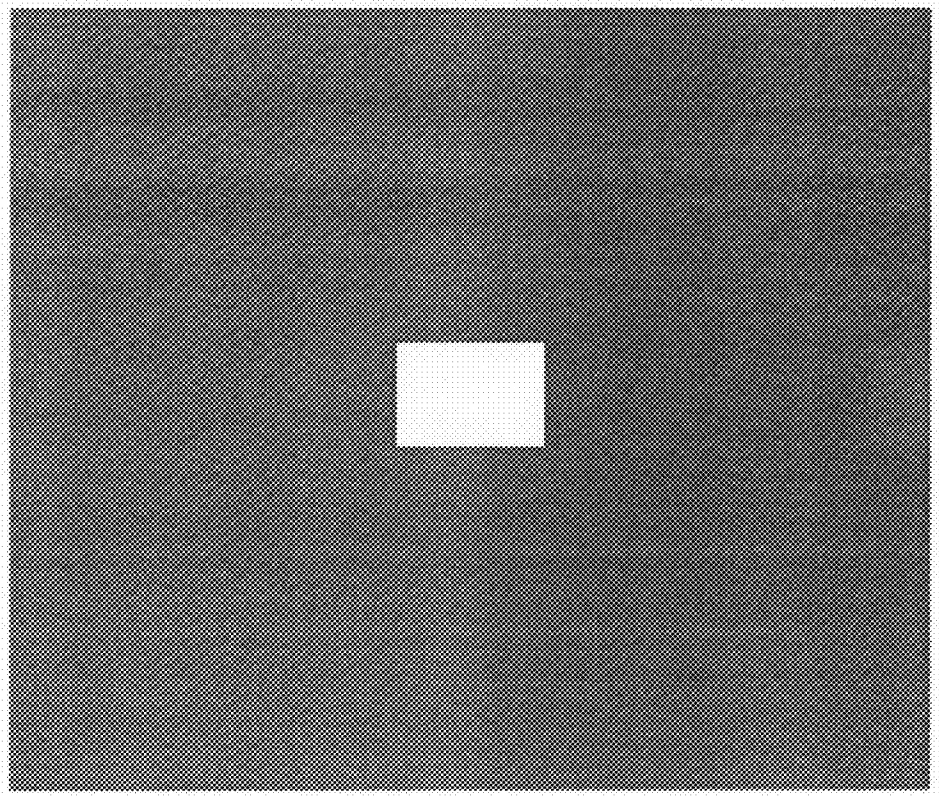
FIG. 2A RELATED ART
FIG. 2A and FIG. 2B are diagrams showing a characteristics of an image which is displayed at the organic light emitting diode display device of the related art.
Figure 2B:
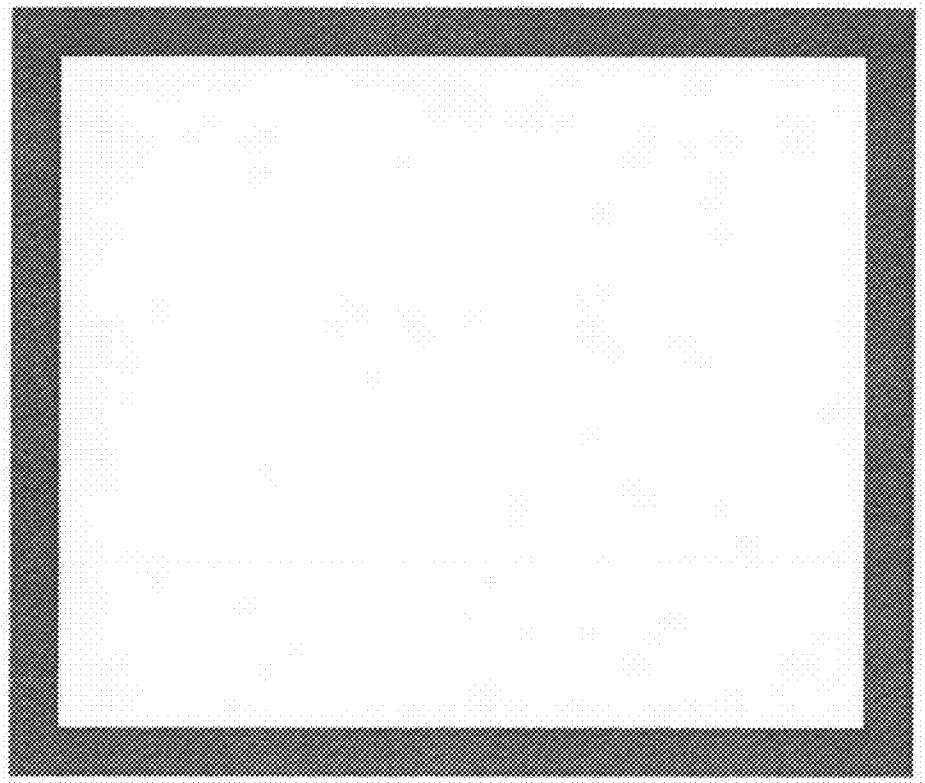
FIG. 2B RELATED ART

A plurality of data lines DL1 to DLm and a plurality of gate lines GL1 to GLn are perpendicularly crossed each other at the display panel 110. A pixel including an organic light emitting diode is formed at a crossing part thereof, and an equivalent circuit in FIG. 1 is formed at the pixel.

The timing controller 120 receives an image data from a system such as a TV set or a computer monitor, etc to supply a digital data to the data driver 140 and, at the same time control a driving of the digital data. To this end, the timing controller 120 generates a data driving control signal DCC and a gate driving control signal GDC using horizontal/vertical synchronization signals H and V from a system in response to a clock signal CLK from a system. The data driving control signal DCC is supplied to the data driver 140, and the gate driving control signal GDC is supplied to the gate driver 150. Herein, the data driving control signal DDC includes a source shift clock SSC, a source start pulse SSP, and a source output enable signal SOE, etc. The gate driving control signal GDC includes a gate start pulse GSP and a gate output enable signal GOE, etc.

Furthermore, the timing controller 120 detects brightness values of each pixel using image data of an inputted current frame and calculates maximum brightness values of each pixel among detected brightness values. The timing controller 120 adds all detected maximum brightness values of each pixel, and then calculates an average brightness value of a current frame using the added value. The timing controller 120 calculates a gamma reference voltage weight, which is set to correspond to a calculated average brightness value among predetermined gamma reference voltage weights which are set to a predetermined look-up table, to supply it to the gamma reference voltage generator 130. Herein, gamma reference voltage weights having gamma reference voltages, which are increased step by step, gamma reference voltage weights having gamma reference voltages, which are decreased step by step, and gamma reference voltage weights, which are not increased and decreased, are set to a predetermined look-up table. For example, one gamma reference voltage weight among predetermined gamma reference voltage weights is gamma reference voltages 5.1V to 5.9V, which are increased from 5.1V to 5.9V by 0.1V step by step. Furthermore, one gamma reference voltage weight among predetermined gamma reference voltage weights is gamma reference voltages 7.9V to 7.1V, which are decreased from 7.9V to 7.1V by 0.1V step by step.

If a gamma reference voltage weight is supplied from the timing controller 120, the gamma reference voltage generator 130 changes a gamma reference voltage with which the data driver 140 is supplied step by step in accordance with the gamma reference voltage weight.

Figure 4A:
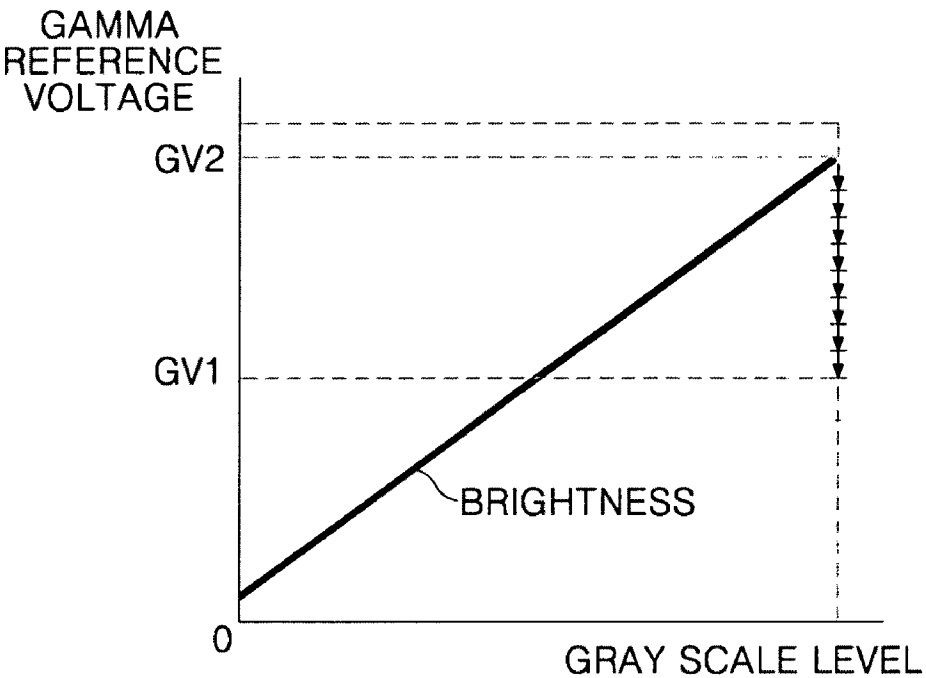
FIG. 4A and FIG. 4B are diagrams showing a characteristics of a driving of the organic light emitting diode display device according to the present invention.

For example, if an image of a current frame is a bright image, the gamma reference voltage generator 130 decreases a high-level gamma reference voltage GV2 to a low-level gamma reference voltage GV1 step by step in accordance with a gamma reference voltage weight as shown in FIG. 4A. In this case, brightness is decreased step by step proportional to the step by step decreased gamma reference voltage.

Figure 4B:
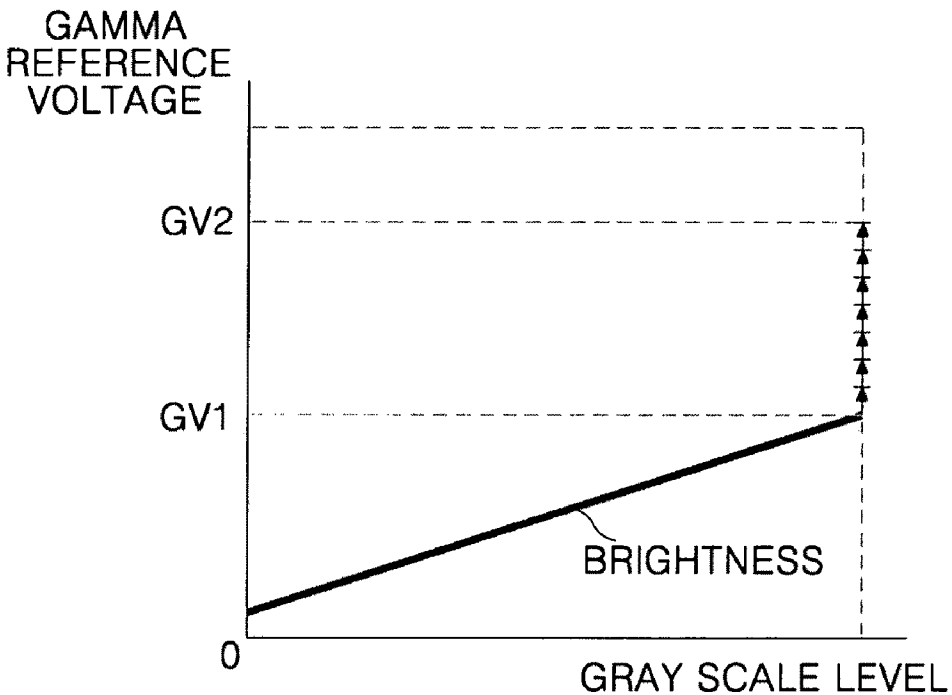

If an image of a current frame is a dark image, the gamma reference voltage generator 130 increases a low-level gamma reference voltage GV1 to a high-level gamma reference voltage GV2 step by step in accordance with a gamma reference voltage weight as shown in FIG. 4B. In this case, brightness is increased step by step proportional to the step by step increased gamma reference voltage.

The data driver 140 converts a digital data from the timing controller 120 into an analog data voltage to supply it to the data lines DL1 to DLm in response to a data driving control signal DDC which is supplied from the timing controller 120. Herein, the data driver 140 increases or decreases an analog data voltage, which is converted on the basis of a gamma reference voltage which is changed step by step and supplied from the gamma reference voltage generator 130, step by step to supply it to a plurality of data lines DL1 to DLm.

For example, if a gamma reference voltage, which is supplied from the gamma reference voltage generator 130, is increased step by step, the data driver 140 increases an analog data voltage, which is converted in accordance with the step by step increased gamma reference voltage, step by step to supply it to a plurality of data lines DL1 to DLm.

For another example, if a gamma reference voltage, which is supplied from the gamma reference voltage generator 130, is decreased step by step, the data driver 140 decreases an analog data voltage, which is converted in accordance with the step by step decreased gamma reference voltage, step by step to supply it to a plurality of data lines DL1 to DLm.

For another example, if a gamma reference voltage, which is supplied from the gamma reference voltage generator 130, is not changed, the data driver 140 supplies an analog data voltage, which is converted in accordance with a constant gamma reference voltage, to a plurality of data lines DL1 to DLm without a change of the analog data voltage.

The gate driver 150 sequentially supplies a scanning pulse to the gate lines GL1 to GLn in response to a gate driving control signal GDC and a gate shift clock GSC which are supplied from the timing controller 120.

Figure 5:
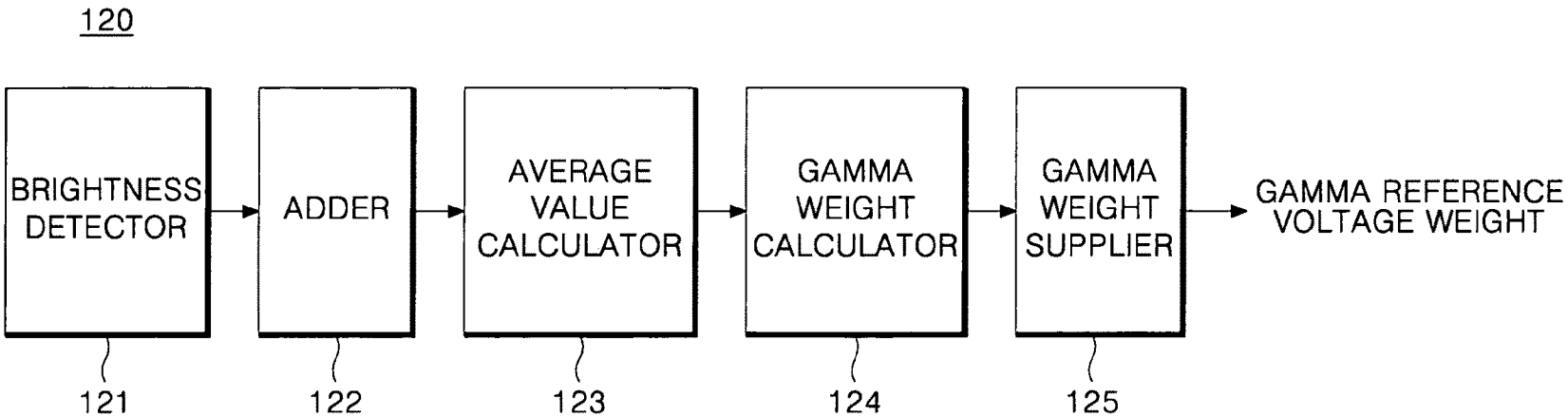
FIG. 5 is a configuration of the timing controller in FIG. 3.

FIG. 5 is a configuration of the timing controller in FIG. 3.

Referring to FIG. 5, the timing controller 120 includes a brightness detector 121, an adder 122, an average calculator 123, a gamma weight calculator 124, and a gamma weight supply 125. Herein, the brightness detector 121 detects brightness values of each pixel using image data of an inputted current frame and calculates maximum brightness values of each pixel among detected brightness values. The adder 122 adds all maximum brightness values of each pixel which are detected by the brightness detector 121. The average calculator 123 calculates a gamma reference voltage weight which is set to correspond to a calculated average brightness value among predetermined gamma reference voltage weights. The gamma weight supply 125 supplies a gamma reference voltage weight, which is calculated by the gamma weight calculator 124, to the gamma reference voltage generator 130.

The brightness detector 121 analyzes gray scale levels of image data of a current frame, which is inputted from a system, for each pixel, and then detects RGB brightness values of each pixel using gray scale levels of analyzed image data. Herein, if image data is RGB data, the brightness detector 121 analyzes gray scale levels of RGB data of each pixel, and then detects RGB brightness values of each pixel using gray scale levels of analyzed RGB data. In this way, if a brightness value is calculated, the brightness detector 121 calculates a maximum brightness value among RGB brightness values of each pixel to output a maximum brightness value of each pixel to the adder 122.

The adder 122 adds all maximum brightness values of each pixel, which are detected by the brightness detector 121, to output an added value of maximum brightness values to the average value calculator 123.

The average value calculator 123 divides an added value of maximum brightness values, which are inputted from the adder 122, by a predetermined resolution to calculate the share as an average brightness value of a current frame, thereby outputting it to the gamma weight calculator 124. Herein, an average brightness value of a current frame is an average brightness value of each pixel.

The gamma weight calculator 124 compares an average brightness value of a current frame, which is calculated by the average value calculator 123, with a predetermined reference brightness value to calculate a gamma reference voltage weight, which is set to a predetermined look-up table, in accordance with the compared result.

If the calculated average brightness value of a current frame is the same as a predetermined reference brightness value, the gamma weight calculator 124 calculates a gamma reference voltage weight, which maintains a current gamma reference voltage, from a predetermined look-up table.

If a calculated average brightness value of a current frame is higher than a predetermined reference brightness value, the gamma weight calculator 124 calculates a gamma reference voltage weight, which is set to correspond to an average brightness value, which is calculated with reference to gamma reference weights having gamma reference voltages, which are decreased step by step among gamma reference voltage weights which are set to a predetermined look-up table. In this case, a calculated gamma reference voltage weights are gamma reference voltages which are decreased step by step, and are used for decreasing a gamma reference voltage step by step in order to decrease brightness step by step at a bright image. A gamma reference voltage is decreased step by step at a bright image in accordance with a gamma reference voltage weight, so that the present invention can reduce damage with which the organic light emitting diode and the driving transistor thereof are applied.

If a calculated average brightness value of a current frame is lower than a predetermined reference brightness value, the gamma weight calculator 124 calculates a gamma reference voltage weight, which is set to correspond to an average brightness value, which is calculated with reference to gamma reference weights having gamma reference voltages, which are increased step by step among gamma reference voltage weights which are set to a predetermined look-up table. In this case, a calculated gamma reference voltage weights are gamma reference voltages which are increased step by step, and are used for increasing a gamma reference voltage step by step in order to increase brightness step by step at a dark image. A gamma reference voltage is increased step by step at a dark image in accordance with a gamma reference voltage weight, so that the present invention can reduce damage with which the organic light emitting diode and the driving transistor thereof are applied.

The gamma weight supply 125 supplies a gamma reference voltage weight, which is calculated by the gamma weight calculator 124, to the gamma reference voltage generator 130.

As described above, the present invention changes a gamma reference voltage step by step in accordance with an image brightness of a current frame, which is inputted from a system, to reduce damage with which the organic light emitting diode and the driving transistor thereof are applied.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An organic light emitting diode display device, comprising:

a brightness detector that calculates a maximum brightness value of each pixel using inputted image data of current frame;

an adder that adds all maximum brightness values of each pixel which are detected by the brightness detector;

an average value calculator that calculates an average brightness value of a current frame using an added value of maximum brightness values which are added by the adder;

a gamma weight calculator that calculates a gamma reference voltage weight which is set to correspond to the calculated average brightness value among predetermined gamma reference voltage weights; and a gamma reference voltage generator that changes a gamma reference voltage step by step in accordance with a gamma reference voltage weight which is calculated by the gamma weight calculator, wherein the gamma weight calculator stores a predetermined look-up table where a gamma reference voltage weight, which maintains a gamma reference voltage, gamma reference voltage weights having gamma reference voltages, which are increased step by step, and gamma reference voltage weights having gamma reference voltages, which are decreased step by step, are set, and wherein the gamma weight calculator compares the calculated average brightness value of a current frame with a predetermined reference brightness value to calculate a gamma reference voltage weight, which is set to the predetermined look-up table, in accordance with the compared result, thereby supplying it to the gamma reference voltage generator.

2. The organic light emitting diode display device according to claim 1, wherein the brightness detector analyzes gray scale levels of the inputted image data of a current image for each pixel, and then detects brightness values of each pixel using analyzed gray scale levels of image data.

3. The organic light emitting diode display device according to claim 2, wherein the brightness detector calculates a maximum brightness value of each pixel among detected brightness values of each pixel to output it to the adder.

4. The organic light emitting diode display device according to claim 1, wherein the average value calculator divides an added value of the maximum brightness values by a predetermined resolution to calculate the share as an average brightness value of a current frame, thereby outputting it to the gamma weight calculator.

5. The organic light emitting diode display device according to claim 1, wherein if the calculated average brightness value of a current frame is the same as the predetermined reference brightness value, the gamma weight calculator calculates the gamma reference voltage weight, which maintains a gamma reference voltage, from the predetermined look-up table.

6. The organic light emitting diode display device according to claim 5, wherein the gamma reference voltage generator maintains a level of a gamma reference voltage, which is being supplied at the present time, in accordance with the gamma reference voltage weight which maintains a gamma reference voltage.

7. The organic light emitting diode display device according to claim 1, wherein if the calculated average brightness value of a current frame is higher than the predetermined reference brightness value, the gamma weight calculator calculates a gamma reference voltage weight, which is set to correspond to the calculated average brightness value among the gamma reference voltage weights having the gamma reference voltages which are decreased step by step, from the predetermined look-up table.

8. The organic light emitting diode display device according to claim 7, wherein the gamma reference voltage generator decreases a gamma reference voltage, which is supplied in accordance with a gamma reference voltage weight which is calculated by the gamma weight calculator among the gamma reference voltage weights having the gamma reference voltages which are decreased step by step, step by step.

9. The organic light emitting diode display device according to claim 1, wherein if the calculated average brightness value of a current frame is lower than the predetermined reference brightness value, the gamma weight calculator calculates a gamma reference voltage weight, which is set to correspond to the calculated average brightness value among the gamma reference voltage weights having the gamma reference voltages which are increased step by step, from the predetermined look-up table.

10. The organic light emitting diode display device according to claim 9, wherein the gamma reference voltage generator increases a gamma reference voltage, which is supplied in accordance with a gamma reference voltage weight which is calculated by the gamma weight calculator among the gamma reference voltage weights having the gamma reference voltages which are increased step by step, step by step.

11. The organic light emitting diode display device according to claim 1, further comprising:

a data driver that converts an analog data voltage step by step proportional to a gamma reference voltage, which is changed step by step and supplied from the gamma reference voltage generator, to supply it to data lines on a display panel, and wherein the brightness detector, the adder, the average value calculator and the gamma weight calculator are incorporated into a timing controller for controlling a driving timing of the data driver.

12. A method of driving an organic light emitting diode display device, comprising:

calculating a maximum brightness value of each pixel using inputted image data of a current frame;

adding the calculated all maximum brightness values of each pixel to calculate an added value of maximum brightness values of each pixel;

calculating an average brightness value of a current frame using an added value of the maximum brightness values;

calculating a gamma reference voltage weight which is set to correspond to the calculated average brightness value among determined gamma reference voltage weights; and changing a gamma reference voltage step by step in accordance with the calculated gamma reference voltage weight, wherein the step of calculating the gamma weight calculates a gamma reference voltage weight from a predetermined look-up table where a gamma reference voltage weight, which maintains a gamma reference voltage, gamma reference voltage weights having gamma reference voltages, which are increased step by step, and gamma reference voltage weights having gamma reference voltages, which are decreased step by step, are set, and wherein the step of calculating the gamma weight compares the calculated average brightness value of a current frame with a predetermined reference brightness value to calculate a gamma reference voltage weight, which is set to the predetermined look-up table, in accordance with the compared result.

13. The method of driving the organic light emitting diode display device according to claim 12, wherein the step of calculating the maximum brightness value analyzes gray scale levels of the inputted image data of a current image for each pixel, and then detects brightness values of each pixel using analyzed gray scale levels of image data.

14. The method of driving the organic light emitting diode display device according to claim 13, wherein the step of calculating the maximum brightness value calculates a maximum brightness value of each pixel among the detected brightness values of each pixel.

15. The method of driving the organic light emitting diode display device according to claim 12, wherein the step of calculating the average brightness value divides an added value of the maximum brightness values by a predetermined resolution to output the share as an average brightness value of a current frame.

16. The method of driving the organic light emitting diode display device according to claim 12 wherein if the calculated average brightness value of a current frame is the same as the predetermined reference brightness value, the step of calculating the gamma weight calculates the gamma reference voltage weight, which maintains a gamma reference voltage, from the predetermined look-up table.

17. The method of driving the organic light emitting diode display device according to claim 16, wherein the step of generating the gamma reference voltage maintains a level of a gamma reference voltage, which is being supplied at the present time, in accordance with the gamma reference voltage weight which maintains a gamma reference voltage.

18. The method of driving the organic light emitting diode display device according to claim 12, wherein if the calculated average brightness value of a current frame is higher than the predetermined reference brightness value, the step of calculating the gamma weight calculates a gamma reference voltage weight, which is set to correspond to the calculated average brightness value among the gamma reference voltage weights having the gamma reference voltages which are decreased step by step, from the predetermined look-up table.

19. The method of driving the organic light emitting diode display device according to claim 18, wherein the step of gamma reference voltage decreases a gamma reference voltage, which is supplied in accordance with a calculated gamma reference voltage weight among the gamma reference voltage weights having the gamma reference voltages which are decreased step by step, step by step.

20. The method of driving the organic light emitting diode display device according to claim 12, wherein if the calculated average brightness value of a current frame is lower than the predetermined reference brightness value, the step of calculating the gamma weight calculates a gamma reference voltage weight, which is set to correspond to the calculated average brightness value among the gamma reference voltage weights having the gamma reference voltages which are increased step by step, from the predetermined look-up table.

21. The method of driving the organic light emitting diode display device according to claim 20, wherein the step of generating the gamma reference voltage increases a gamma reference voltage, which is supplied in accordance with a calculated gamma reference voltage weight among the gamma reference voltage weights having the gamma reference voltages which are increased step by step, step by step.

* * * * *